United States Patent [19]

Laubach et al.

[11] 4,069,975

[45] Jan. 24, 1978

[54] MIXER TRUCK FOR SHIPPING MOLTEN METALS

[75] Inventors: Winfried Laubach; Kienbaum, both of Oberhausen; Rolf Thomas, Bottrop, all of Germany

[73] Assignee: Gutehoffnungshutte Sterkrade Aktiengesellschaft, Germany

[21] Appl. No.: 743,917

[22] Filed: Nov. 22, 1976

[30] Foreign Application Priority Data

Dec. 9, 1975 Germany ..... 2555198

[51] Int. Cl.[2] ..... B28C 5/18

[52] U.S. Cl. ..... 366/220; 366/62

[58] Field of Search ..... 242/172, 176, 175, 177 R, 242/3, 81 R

[56] References Cited

U.S. PATENT DOCUMENTS

| | | | |
|---|---|---|---|
| 1,801,162 | 4/1931 | Jaeger | 259/177 R |
| 2,895,722 | 7/1959 | Hunkins | 259/176 X |
| 3,942,453 | 3/1976 | Stabel | 259/81 R |

*Primary Examiner*—Edward J. McCarthy
*Attorney, Agent, or Firm*—McGlew and Tuttle

[57] ABSTRACT

A mixer truck for shipping molten metals in an elongated, substantially cylindrical vessel, which has an end portion with a plurality of annular bearing rings extending therearound, comprises a truck body with a frame plate girder which is universally mounted on the body. The frame plate girder carries two spaced sets of rollers forming a rotational cradle support for each of the ring members on the cylindrical vessel. A drive motor, carried on the universally mounted frame plate girder, is connected to drive a sprocket wheel or gear extending around the vessel between the rings.

2 Claims, 2 Drawing Figures

MIXER TRUCK FOR SHIPPING MOLTEN METALS

FIELD AND BACKGROUND OF THE INVENTION

This invention relates in general to the construction of mixer trucks and, in particular, to a new and useful mixer truck for shipping molten metals in elongated cylindrical vessels which includes a universally mounted frame plate girder on the truck having spaced apart sets of rollers which form a rotational cradle support for rotatably supporting the vessel on runners which extend around its periphery and which includes a drive motor on the plate girder having a drive gear which is connected to drive a gear or sprocket on the vessel.

DESCRIPTION OF THE PRIOR ART

The subject of the invention is a mixer truck for shipping molten metals in an elongated, substantially cylindrical vessel, with a conically tapered center part and end parts recessed in steps or, if they have the same diameter, passing over into one another, where the rotation is effected over moving rings and runners at the ends of the vessel.

At the present time, power-transmitting driving parts are arranged on the vessel at both sides at a distance from the vertical axis of rotation of the turning socket and, therefore, an additional torque appears resulting from the driving forces. These forces increase the already existing specific loads on the respective diagonally opposed runners and lead to end pressures.

Additionally, conventionally supported runners do not ensure contact over the entire runner width, due to unavoidable deformations caused by the high bearing loads. The resulting uncontrollable higher specific load leads to destruction of the runners and rings, respectively.

SUMMARY OF THE INVENTION

The present invention provides a mixer truck for shipping molten metals which does not have the above-described inconveniences of the prior art, and which ensures linear contact between moving rings and runners over the entire ring width and keeps away additional runner loads from the driving forces in the form of edge pressures.

It was found that such a mixer truck can be provided if the runners which are in contact with the rings of the mixer vessel are arranged to swing in all directions in a framed plate girder carrying the tilting gearing, which bears over a ball turning socket on the bridge of the traveling gear, the power-transmitting driving unit of the tilting gearing being arranged between the rings, and preferably in the center.

Accordingly, it is an object of the invention to provide an improved apparatus for transporting molten metals which includes a truck having a frame plate girder with two longitudinally spaced sets of transversely aligned rollers which rotationally support respective longitudinally spaced runners which extend around the end portions of axially elongated cylindrical mixing vessels, and wherein, the frame plate girder is universally pivotally mounted and carries a drive which advantageously includes a driving pinion engaged with an annular drive gear carried between the annular rings on the vessel.

A further object of the invention is to provide a device for transporting molten metals which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
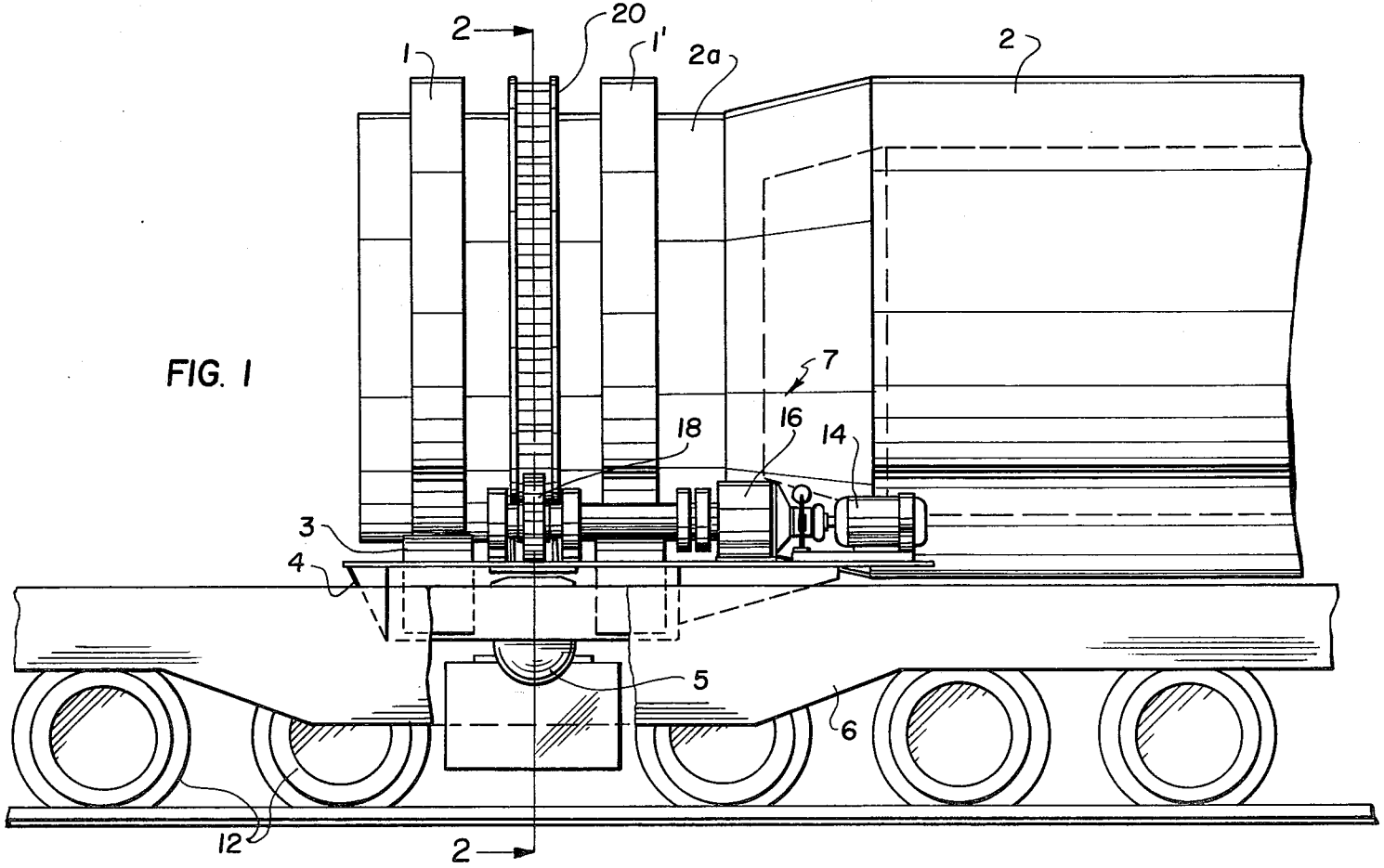
FIG. 1 is a partial side elevational view of a truck for supporting a cylindrical vessel containing molten metal, constructed in accordance with the invention.
Figure 2:
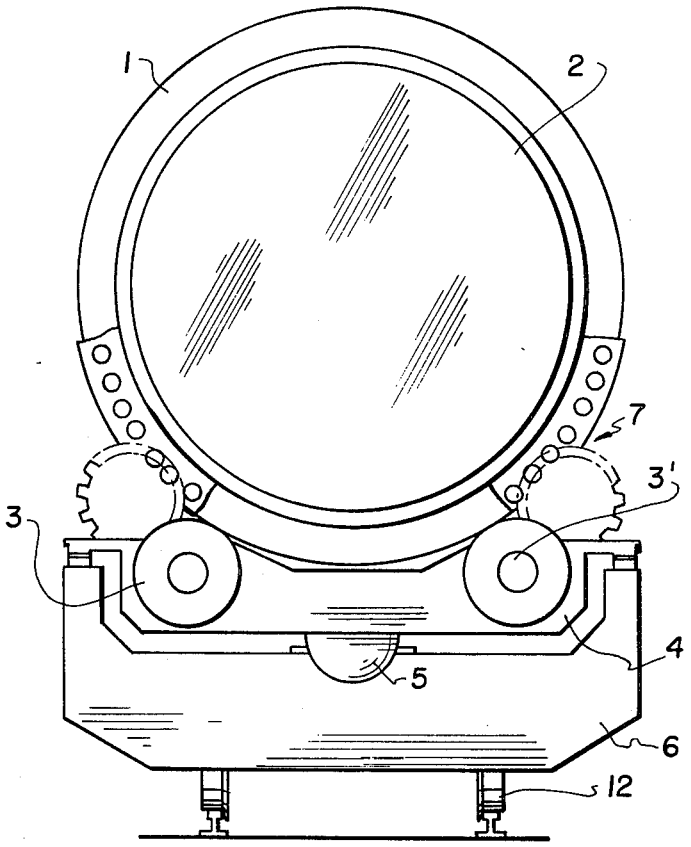
FIG. 2 is a section taken along the line 2—2 of FIG. 1.

Referring to the drawings in particular, the invention embodied therein, comprises a device for transporting molten metals which includes an axially elongated cylindrical mixer vessel 2 having an end section **2*a* of uniform diameter which contains two annular, longitudinally spaced, circumferential rings 1 and 1'** which provide a bearing support for the vessel at each end.

In accordance with the invention, a truck 6 for the transport of the vessel is provided with a plurality of wheels 12 and it carries a central universal or ball pivot 5 for universally pivotally supporting a frame plate girder 4. Two sets of rotational support rollers 3 and 3', which are transversely spaced apart and provide a cradle support for each ring 1 and 1', respectively. The rings engage on rollers 3 and 3' for free rotation thereon and the drive for effecting this rotation is advantageously connected between the two rings 1 and 1' centrally. In the embodiment illustrated, a drive 7 comprises a drive motor 14 driving through a transmission 16 and a drive pinion 18 which are all mounted on the frame plate girder 4. A sprocket or gear ring 20 is carried on the vessel 2 between rings 1 and 1'.

By mounting the frame plate girder 4 so that it may be universally pivoted in all directions, a linear contact of the entire runner width of each runner 1 and 1' may be effected and this excludes a higher specific load caused by edge pressures. In addition, because of this universal mounting, difficulties in moving the vessel around curves and which may be caused by sagging of vessel 2, are avoided. A concentric arrangement of the drive between the annular rings on the vessel and the pivotal mounting of the rollers which support the rings on a frame plate girder for swinging in all directions produces no torque about the vertical axis of rotation of the frame plate girder and can thus not lead to any edge pressures.

While a specific embodiment of the invention has been shown and described in detail to illustrate the application of the principles of the invention, it will be understood that the invention may be embodied otherwise without departing from such principles.

What is claimed is:

1. An apparatus for transporting molten metals, comprising a wheeled truck, a frame plate girder universally pivotally mounted on said truck, first and second longitudinally spaced sets of transversely separated rollers mounted on said frame plate girder, a longitudinally elongated cylindrical vessel having an end section with longitudinally spaced rings extending therearound engaged on the respective roller sets on said frame plate girder, and drive means on said frame plate girder including a driving gear, said vessel having a driven gear member thereon between said rings engaged by said driving gear.

2. A mixer rail truck for shipping molten metals by railway in an elongated, substantially cylindrical vessel which has an end portion with two longitudinally spaced annular bearing rings extending therearound, comprises a truck body, a frame plate girder, means universally pivotally mounting said frame plate girder on said truck body, two sets of two laterally spaced support rollers on said frame plate each including two transversely arranged support rollers on said frame plate girder on each side of the axis thereof positioned to engage a respective ring and rotationally support said vessel, a drive motor on said frame plate girder, and drive gear means connected between said drive motor and said vessel between said rings to rotate said vessel.

* * * * *